United States Patent [19]

Chattopadhayay et al.

[11] 3,931,803

[45] Jan. 13, 1976

[54] FUEL QUANTITY MANIFOLD FOR MULTI-CYLINDER INTERNAL COMBUSTION ENGINES

[76] Inventors: Asoke Chattopadhayay, Ulmenallee 134, 4041 Norf; Wolfgang Müller, 4044 Kaarst, both of Germany

[22] Filed: Jan. 17, 1975

[21] Appl. No.: 541,920

[30] Foreign Application Priority Data

Jan. 18, 1974 Germany ..... 2363726

[52] U.S. Cl.. 123/139 AW; 123/39 AB; 123/139 R; 137/625.46

[51] Int. Cl.[2] ..... F02M 69/00

[58] Field of Search.. 123/139 AB, 139 AW, 139 R; 137/625.46

[56] References Cited

UNITED STATES PATENTS

| | | | |
|---|---|---|---|
| 1,328,142 | 1/1920 | Fekete | 123/139 AW |
| 2,869,526 | 1/1959 | Dolza | 123/139 AW |
| 2,884,006 | 4/1959 | Hoback | 123/139 AW |
| 3,057,300 | 10/1962 | Ulbing | 123/139 BC |
| 3,085,594 | 4/1963 | Spragens | 137/625.46 |
| 3,628,515 | 12/1971 | Knapp | 123/139 AW |
| 3,730,155 | 5/1973 | Knapp | 123/139 AW |
| 3,868,970 | 3/1975 | Ayers et al. | 137/625.46 |
| 3,892,259 | 7/1975 | McClocklin | 137/625.46 |

FOREIGN PATENTS OR APPLICATIONS

| | | | |
|---|---|---|---|
| 912,480 | 12/1958 | United Kingdom | 123/139 AW |
| 900,631 | 12/1953 | Germany | 123/139 AW |

*Primary Examiner*—Wendell E. Burns
*Assistant Examiner*—James W. Cranson, Jr.
*Attorney, Agent, or Firm*—Haseltine, Lake & Waters

[57] ABSTRACT

A fuel quantity manifold for a multiple-cylinder internal combustion engine with two cylindrical dosing elements supported within a cylindrically-bored housing in mutually end surface contacting and in relative to each other rotatable relationship, and which are provided with metering passageways, wherein the end surface edges of the metering passageways overlap each other so as to release or open a more or less large flow passage cross-section.

11 Claims, 3 Drawing Figures

FUEL QUANTITY MANIFOLD FOR MULTI-CYLINDER INTERNAL COMBUSTION ENGINES

FIELD OF THE INVENTION

The present invention relates to a fuel quantity distributor or manifold for a multiple-cylinder internal combustion engine with two cylindrical dosing elements supported within a cylindrically-bored housing in mutually end surface contacting and in relative to each other rotatable relationship, and which are provided with metering passageways, wherein the end surface edges of the metering passageways overlap each other so as to release or open a more or less large flow passage cross-section.

DISCUSSION OF THE PRIOR ART

Heretofore, bores or slits have been utilized as metering passageways. The overlapping bores, at a small opening, form a rhomboid-shaped slit which becomes increasingly wider so as to assume a circular shape at full opening. The overlapping or rectangularly cross-sectioned slits which are controlled by the dimension of the covering, primarily or exclusively vary in only one dimension.

Those types of fuel quantity manifolds can only be precisely adjusted for predetermined fuel temperature within the range of idle operating condition until part-load operating condition, in which there is opened one-third of the maximum flow passage cross-section. For other fuel temperatures and, consequently, different fuel viscosities, there occur unequal control deviations, which have their origin that, in the plane of the flow passage cross-section, there is an appreciable variation in the ratio of the moistened or wetted periphery with respect to the inscribed circle within the indicated control range. For a smaller opening, in essence, meaning at the idle operating condition, the then present slit-shaped flow passage cross-section is particularly unsatisfactory at viscosity changes.

SUMMARY OF THE INVENTION

Accordingly, it is an object of the invention to avoid the above-mentioned disadvantages encountered in the art, and in which the fuel quantity distribution to the individual combustion chambers of the internal combustion engine is substantially maintained free from the disadvantageous influences of varied fuel viscosities.

Inventively, this object is attained in that, in the plane of the flow passage cross-section, the ratio of the moistened or wetted periphery to the diameter of the inscribed circle is maintained approximately constant from the idle operating condition until at least the part-load condition, in which a third of the maximum flow passage cross-section is opened, and thereby does not exceed the value of 6.0.

The foregoing affords that already within the critical range of the idle operating condition there is afforded an opening cross-section which does not excessively deviate from the circular shape which is recognized as particularly advantageous.

Suitably, the metering passageways are radially outwardly thereof defined by the cylinder cover surface of the housing, and interiorly, respectively, sidewise, by one or more straight or curved surfaces of the dosing elements. This construction of the metering passageway is quite desirable as viewed from a manufacturing standpoint. Thus, it affords a simple and concurrent material-removing machining of both dosing elements in a single work operation and, consequently, a correlated contouring at the overlap location.

Advantageously, the tangent at the side surface of a metering passageway in conjunction with the tangent at the cylinder surface of the dosing element, as measured in cross-section at the contact line, subtends or encompasses an angle of not less than 40° and not more than 80°, preferably 60°. In the limiting instance, namely, when the side wall surface of the metering passageway is a plane or flat surface, the tangent is then located within the plane of the surface.

In a further embodiment of the invention, the metering passageways, at the cylindrical surface of the dosing elements, form channels which are triangular, trapezoidal, cylindrically-segmented, cylindrically-cutout like, or which are combined from these shapes. The above-mentioned shapes may be particularly simply manufactured, and with the thus formed channels the previously above referred to metering control requirement may be fulfilled.

The advantages of the invention lie in that also within the dosing or metering ranges in which there are present only small opening cross-sections, these open cross-sections have a form which is not too remote from a circular configuration so that, up to the part-load condition in which one-third of the maximum flow passage cross-section is opened, these cross-sectional shapes do not appreciably vary whereby no disturbing unbalanced control deviations, respectively, fuel metering deviations, occur at various fuel viscosities.

BRIEF DESCRIPTION OF THE DRAWINGS

Reference may now be had to the following detailed description of a preferred embodiment of the invention, taken in conjunction with the accompanying drawing; in which.

DETAILED DESCRIPTION

A cylindrically bored housing 11 includes a fuel inlet aperture 12, and four fuel outlet apertures of which there may be ascertained only the fuel outlet apertures 13 and 14.

Figure 1:
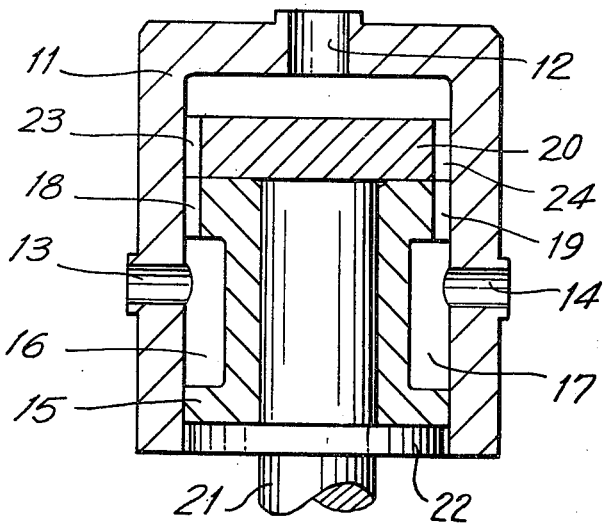
FIG. 1 shows a longitudinal sectional view through a fuel quantity manifold constructed according to the present invention.

A dosing element 15, which is pressed into the central bore of the housing 11, includes four recesses equally distributed about the periphery thereof, of which there are visible only the recesses 16 and 17. The recesses are each respectively connected with an associated metering passageway. Only the metering passageways 18 and 19 are ascertainable in FIG. 1 of the drawing.

At the end surfaces thereof, the dosing element 15 is provided with planar parallel polished surfaces. A second dosing element 20 which is similarly provided with planar parallel polished end surfaces, is rotatably supported within the central bore of the housing 11. The second dosing element is rigidly fastened to a shaft 21. By means of the coupling 22 which is similarly rigidly connected with the shaft 21, the dosing element 20 is fixed so that, upon rotation of the shaft 21, its lower end surface slides along the upper end surface of the dosing element 15.

The dosing element 20 also possesses four metering passageways which are uniformly spaced abouts its periphery, of which there are visible only the metering passageways 23 and 24. The various metering passageways singly have one of the cross-sectional shapes shown in FIG. 2.

Since the metering passageways for the mutually superimposed dosing elements 15 and 20 are concurrently manufactured in a paired material-removing sequence, they are provided pairwise, in the contact plane thereof with completely exactly equal cross-sectional shapes and angular locations.

Figure 2:
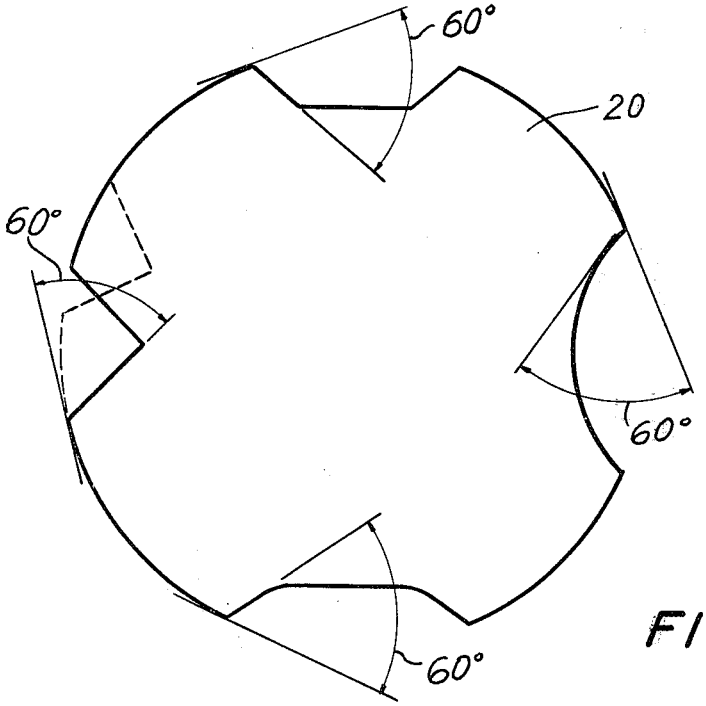
FIG. 2 shows a top plan view of a dosing element, about the periphery of which there may be recognized four different metering passageways which are constructed pursuant to the invention.

FIG. 2 illustrates the dosing element 20 in a top plan view thereof. For illustration of the possible various cross-sectional shapes, in a deviation from an actual practical construction, there are shown different cross-sectional shapes for the metering passageways and, namely, at the left a triangular, at the top a trapezoidal, at the right a cylindrically segmented, and at the bottom a combination or composite form.

Figure 3:
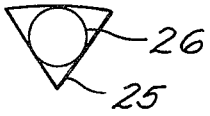
FIG. 3 shows an enlarged detail of a metering passageway with an inscribed circle.

At the left, shown in dash lines at the triangular cross-sectional shape, there is illustrated as to how the flow passage cross-section changes through displacement of the dosing elements relative to each other. For this purpose, in FIG. 3 there is illustrated the wetted periphery 25 and the inscribed circle 26 which is present in the plane of the flow passage cross-section.

While there has been shown what is considered to be the preferred embodiment of the invention, it will be obvious that modifications may be made which come within the scope of the disclosure of the specification.

What is claimed is:

1. In a fuel quantity manifold for multi-cylinder internal combustion engines, a cylindrically bored housing; two cylindrical dosing elements supported within said housing, said dosing elements each having end surfaces thereof in superimposed and mutual relative rotatable relationship; and metering passageways formed in each of said dosing elements having the end surfaced edges thereof in overlapping positions so as to provide a more or less large flow passage cross-section, the improvement comprising: said metering passageways each having, in the plane of the flow passage cross-section between said dosing elements, an approximately constant ratio of the wetted periphery to the diameter of an inscribed circle within the idling operating condition to at least the part-load operating condition of the engines in which one-third of the maximum flow passage cross-section is opened, said ratio being within the value of 6.0.

2. Fuel quantity manifold as claimed in claim 1, said metering passageways each being defined radially outwardly of the cylindrical wall surface of the central bore of the housing and sidewise inwardly by at least one surface of each of said dosing elements.

3. Fuel quantity manifold as claimed in claim 2, said dosing element surface being a planar surface.

4. Fuel quantity manifold as claimed in claim 2, said dosing element surface being a curved surface.

5. Fuel quantity manifold as claimed in claim 1, the side surface of a metering passageway having tangents thereto in conjunction with tangents to the cylindrical surfaces of said dosing elements, as measured along their contact line in cross-section, subtend an angle in the range of about 40° to 80°.

6. Fuel quantity manifold as claimed in claim 5, said angle comprising 60°.

7. Fuel quantity manifold as claimed in claim 2, said metering passageways providing a channel at the cylindrical surface of said dosing elements having a triangular configuration.

8. Fuel quantity manifold as claimed in claim 2, said metering passageways providing a channel at the cylindrical surface of said dosing elements having a trapezoidal configuration.

9. Fuel quantity manifold as claimed in claim 2, said metering passageways providing a channel at the cylindrical surface of said dosing elements having a cylindrically-segmented configuration.

10. Fuel quantity manifold as claimed in claim 2, said metering passageways providing a channel at the cylindrical surface of said dosing elements having a cylindrically-cutout configuration.

11. Fuel quantity manifold as claimed in claim 2, said metering passageways providing a channel at the cylindrical surface of said dosing elements having a composite configuration.

* * * * *